US010970949B2

(12) United States Patent
Ouellet

(10) Patent No.: US 10,970,949 B2
(45) Date of Patent: Apr. 6, 2021

(54) SECURE ACCESS CONTROL

(71) Applicant: Genetec Inc., St-Laurent (CA)

(72) Inventor: Sylvain Ouellet, Laval (CA)

(73) Assignee: GENETEC INC., St-Laurent (CA)

( * ) Notice: Subject to any disclaimer, the term of this patent is extended or adjusted under 35 U.S.C. 154(b) by 0 days.

(21) Appl. No.: 16/352,797

(22) Filed: Mar. 13, 2019

(65) Prior Publication Data

US 2019/0340858 A1 Nov. 7, 2019

Related U.S. Application Data

(60) Provisional application No. 62/667,149, filed on May 4, 2018.

(51) Int. Cl.
*G07C 9/00* (2020.01)
*G07C 9/28* (2020.01)

(52) U.S. Cl.
CPC ..... *G07C 9/00309* (2013.01); *G07C 9/28* (2020.01); *G07C 2009/00325* (2013.01)

(58) Field of Classification Search
CPC ..... G07C 9/00309; G07C 9/00111; G07C 2009/00325
See application file for complete search history.

(56) References Cited

U.S. PATENT DOCUMENTS

2003/0088777 A1* 5/2003 Bae ..... G07C 9/28 713/181
2004/0162105 A1* 8/2004 Reddy ..... H04L 63/0853 455/551
2005/0127172 A1* 6/2005 Merkert, Sr. ..... G07C 9/22 235/382
2005/0138380 A1* 6/2005 Fedronic ..... G07C 9/27 713/172
2005/0211766 A1 9/2005 Robertson et al.
2008/0097924 A1 4/2008 Carper et al.
2012/0022902 A1* 1/2012 Gressel ..... G07B 15/00 705/5
2013/0221094 A1* 8/2013 Smith ..... G07C 9/00309 235/382
2013/0222107 A1 8/2013 Herscovitch et al.
2014/0281586 A1 9/2014 Loisel et al.
2015/0350199 A1 12/2015 You
2017/0039789 A1* 2/2017 Neely ..... H04L 63/10
2018/0287788 A1* 10/2018 Pital a Garcia ..... H04L 9/0858

OTHER PUBLICATIONS

PCT/CA2019/050592 search report dated Aug. 14, 2019.
PCT/CA2019/050592 written opinion dated Aug. 14, 2019.

* cited by examiner

*Primary Examiner* — Sisay Yacob
(74) *Attorney, Agent, or Firm* — Anglehart et al.

(57) ABSTRACT

An access controller combines one or more Secure Access Modules (SAMs) or other cryptographic processors with embedded storage, individually accessible by the controller such that waiting on the reply from one of the modules does not prevent accessing the others, a host CPU, running the computer program to perform authentication and access control, and a waiting queue, possibly in system memory, to put the request in when all SAMs are used. The state of the SAMs, possibly using system memory, is tracked to be able to find a free access module or to be able to match a response to the corresponding request. One or more connections (serial, network, wireless or otherwise) are used to connect to transparent smart card readers and door controllers.

22 Claims, 8 Drawing Sheets

```
CARD        READER      HOST                    SAM Manager(1)       SAM card
                   <-     Scan
                   ->     Card Present
<------------------------ Authenticate
 ------------------------> Authenticate response with challenge
                                 -----------------> Acquire SAM   (2)
                                 <-----------------  Acquired ID=..

                                  ----------------------------------------->   Authenticate Part1
                                  <-----------------------------------------    Authenticate Part1 response
<-------------------------- Authenticate Part2
 --------------------------> Authenticate Part2 response
                                  ----------------------------------------->  Authenticate Part2
                                  <-----------------------------------------  Authenticate Part2 response
                                  ----------------------------------------->  GenerateMac (3)
                                  <-----------------------------------------  reponse     (4)
<------------------------ Read
------------------------> ReadResponse
                              ------------------------------------------->  Decipher Data
                               <-------------------------------------------  Deciphered credential
                               ----------------------> Release SAM
                                                          --------------->  KillAuthentication
```

Figure 6

SECURE ACCESS CONTROL

This patent application claims priority of U.S. provisional patent application Ser. No. 62/667,149 filed on May 4, 2018, the content of which is hereby incorporated by reference.

TECHNICAL FIELD

This application relates to secure access control systems of the type using secure access modules to authenticate smart card credentials.

BACKGROUND

Access control systems typically consist of one or more door controllers, a plurality of sensors and relays and a plurality of identification cards readers. The controller may be a computer system that has a database of cardholders and access policy, a set of I/O ports and it may be responsible for applying the access policy. The sensors and relays are used to monitor doors states and activate the door strikes to unlock doors when required. Identification card readers communicate with user identification badges and retrieve the users' credentials. That information is conveyed to the door controller, for example by the means of an RS485 bus, a network connection or other communication mechanism. The controller then decides to activate the door strike relay (can also be a magnetic lock) or not.

In low security systems, the identification credential often is an RFID card or fob that provides a serial number when prompted. The serial number received at the card reader is transmitted to the access controller that checks if the serial number is permitted access. With these systems, if the card or fob is read by a third party, it is possible to make a copy of the RFID card or token that can grant access to an intruder.

In higher security systems, the credential can include a cryptographic processor that provides authentication while avoiding the need to exchange a secret or other information that would allow a third party to make a copy of the RFID card or token. Such credentials can be "smart cards".

When authenticating a smart card, it is known in the art to use secure access modules that can be similar in design to smart cards and provide the counterpart cryptographic processing to establish the identity of the RFID card presented to the reader device. A secure access module (SAM) provides for storage for the cryptographic keys and algorithms that is more secure than when a regular computer platform is used, because the SAM has a tamper-proof package whose memory is not readable from the outside. As is known in the art of financial transaction point-of-sale (POS) terminals, a secure access module or SAM can be connected to a slot in a device that has a card reader and PIN keypad. The cryptographic exchange between the client's smart card and the SAM is done using keys that are securely stored in the SAM and smart card, and the communication can be encrypted so that no compromising eavesdropping is possible. The SAM provides to the controller or microprocessor of the device a message that the card is authenticated, and the device transmits the authentication information over a bus or network connection.

In access control systems, it is known to use a SAM inside the reader itself or in a module associated with the reader located a small distance from the reader inside of the protected premises. In this case, using a SAM allows the smart card of the user to be authenticated, and the authentication information is then sent to an access controller for making the decision as to whether the user of the card should be granted access. It will be appreciated that the authentication information sent from the reader to the access controller also is best to be encrypted to prevent interception. This requires managing cryptographic keys for that communication.

SUMMARY

According to a first broad aspect of the present application, a SAM associated with a reader for reading an RFID card, badge or token for secure access control is located at the access controller so that encrypted or secure communication between the reader and the SAM is used to ensure security of the communication between the reader and the access controller. This can avoid the need to manage cryptographic keys for that communication outside of the smart card to SAM communication protocol.

According to a second broad aspect of the present application, one or more SAMs are associated with a greater number of readers for reading an RFID card, badge or token for secure access control. In this way, fewer SAMs are required.

In some embodiments, an access controller for use in a secure access control system having a number of smart card readers and door controllers, can be operative to communicate with the smart card readers and door controllers for authenticating users and enabling authorized access to secured premises. The access controller can comprise at least one communication interface connectable to the number of smart card readers and door controllers, a plurality of secure access module (SAM) interfaces, each one of the SAM interfaces able to connect to a corresponding one of a plurality of SAMs.

In some embodiments, an access control method comprises:

- providing an access controller with a plurality of secure access modules (SAMs);
- at smart card readers associated with access control points, establishing communication between user smart cards inserted into or presented to the smart card readers and selected ones of the SAMs in the access controller;
- obtaining credential data from the communication;
- controlling door controllers associated with the access control points based on the credential data.

In one embodiment, the system comprises:

- One or more Secure Access Modules or other cryptographic processor with embedded storage, individually accessible by the controller such that waiting on the reply from one of the modules does not prevent accessing the others.
- A host CPU, running the computer program to perform authentication and access control.
- A waiting queue, possibly in system memory, to put the request in when all Secure Access Modules are used.
- Tracking of the state of the Secure Access Modules, possibly using system memory, to be able to find a free access module or to be able to match a response to the corresponding request.
- One or more connections (serial, network, wireless or otherwise) to transparent smart card readers In some embodiments, there is provided an access control system controller comprising:

- one or more secure access modules (SAM) individually accessible such that waiting on the reply from one of the modules does not prevent accessing the others;

a host CPU and memory storing a computer program to perform authentication and access control;

a waiting queue for SAM requests when all SAMs are in use;

tracking means for tracking a state of the SAMs and able to find a free SAM or able to match a response to a corresponding request; and one or more connections to transparent smart card reader.

In order to process multiple requests in parallel, the process of authenticating cards may operate asynchronously with regards to the SAM dispatching/reservation process, be it with threads, processes or other parallel programming technique.

In a variant, the Waiting queue may be substituted for a Priority Queue. This may be used to prioritize certain access points over other.

In some embodiments, there is provided an access control system, while in other embodiments, there is provided a method of performing access control.

In some embodiments, there is provided an end-to-end encrypted access control system comprising:

a. a central controller comprising a communication interface and an encryption interface for establishing a secure connection with a device over the communication interface;

b. a door controller in communication with the central controller for receiving therefrom instructions to unlock a door; and c. a card reader in communication with the central controller, the card reader operating in a pass-through mode enabling the exchange of data between an access card and the central controller in encrypted form.

In some embodiments, there is provided an end-to-end encrypted access control method comprising:

a. at a card reader establishing communication with an access card, the card reader receiving encrypted data from the access card and transmitting the encrypted data to a central controller without decrypting it;

b. at the central controller, decrypting the encrypted data and establishing an access permission associated with the access card on the basis of the decrypted encrypted data; and c. on the basis of the establishing an access permission, at the central controller communicating with a door controller instruction to unlock a door controlled by the door controller.

Establishing an access permission associated with the access card can further comprise exchanging further encrypted communication with the access card, the further encrypted communications being exchanged via the card reader without decryption thereby.

BRIEF DESCRIPTION OF THE DRAWINGS

The invention will be better understood by way of the following detailed description of embodiments of the invention with reference to the appended drawings, in which:

FIG. 6 is a message diagram illustrating badge to SAM communication during authentication.

DETAILED DESCRIPTION

Figure 1A:
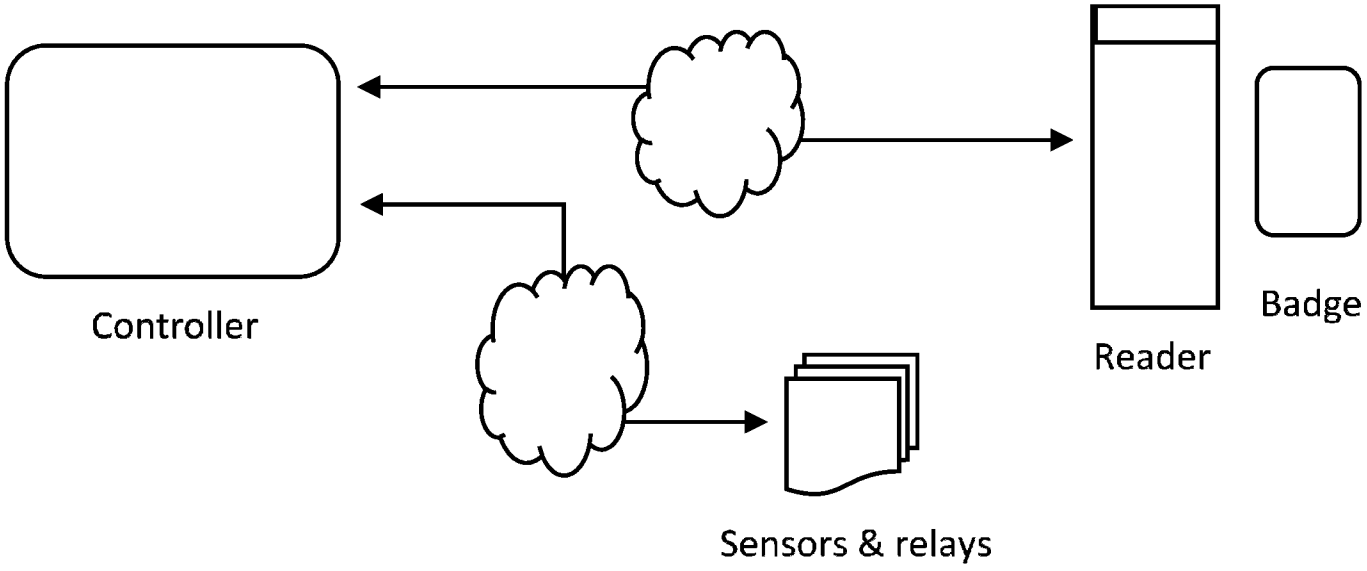
Figure 1A (prior art)
FIG. 1A is a schematic block diagram of an access control system of the state of the art.

Access control systems typically consist of one or more door controller, a plurality of sensors and relays and a plurality of identification cards readers, as shown schematically in FIG. 1A. The controller may be a computer system that has a database of cardholders and access policy, a set of 10 ports and it may be responsible for applying the access policy. The sensors and relays are used to monitor doors states and activate the door strikes to unlock doors when required. Identification card readers communicate with user identification badges and retrieve the user's credentials. That information is conveyed to the door controller e.g. by the means of an RS-485 bus, a network connection or other communication mechanism. The controller then decides to activate the door strike relay (can be magnetic lock) or not.

In high security applications, it is useful to ensure that user identification cannot be stolen, cloned or otherwise tampered with. To this end, contactless smart cards are often used to securely store the user's credential and are comprised of some nonvolatile memory with a small processor all built in the same tamper proof integrated circuit, known as a secure access module or SAM. A cryptographic challenge can prevent access to the stored information without knowledge of a secret key. The secret key can then also be known by the Access Control System.

Figure 1B:
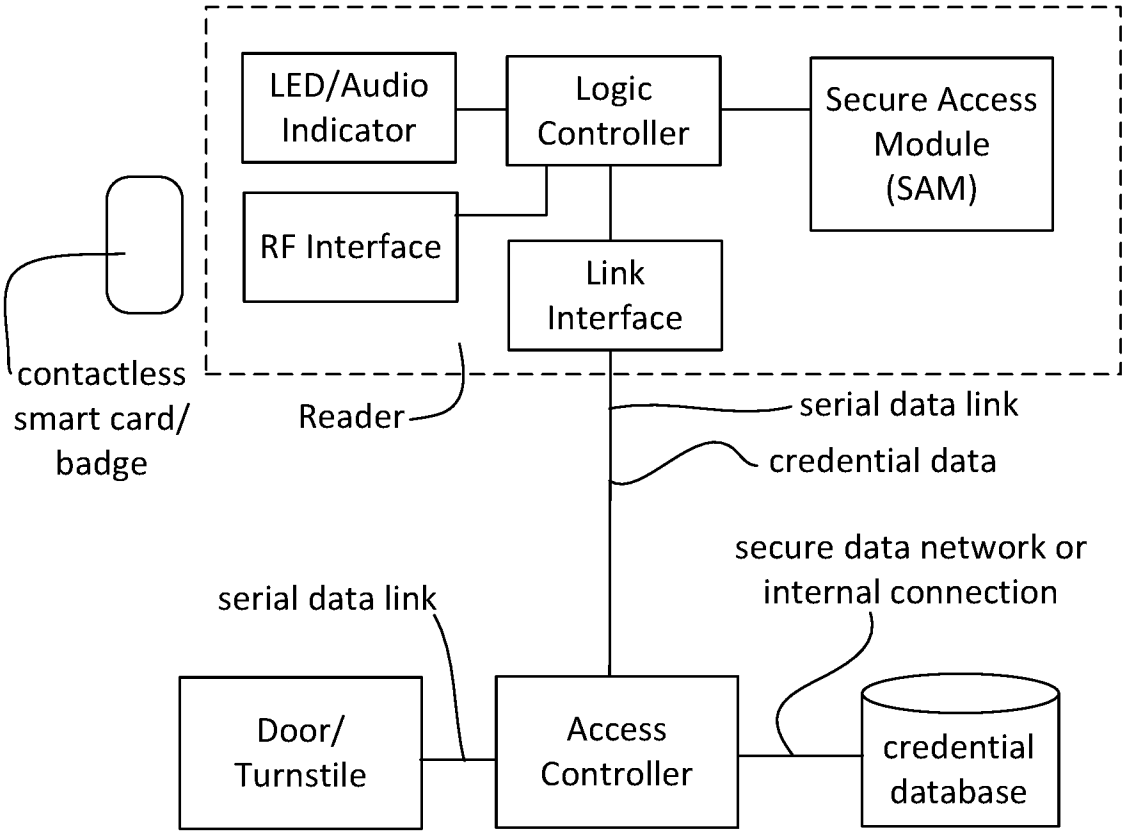
Figure 1B (prior art)
FIG. 1B is a schematic block diagram of an access control system of the state of the art in which a SAM is part of an RFID reader for smart cards.

With reference to FIG. 1B, the operation of the secure access module within a card reader will be described. When a smart card is presented to the reader, an RF interface is active to detect the presence of an antenna contained within a smart card or badge (a card reader can use electrical contacts instead of wireless coupling, as is known in the art). To conserve power, this can be a series of pulses instead of a continuous interrogation, as is known in the art. When a card is detected, the RF interface transmits a signal that delivers power to the smart card, thus powering its processor for operation. The RF interface is configured to modulate and demodulate data transmitted between the smart card and the reader. The logic controller of the reader can be a microcontroller that communicates the data between the RF interface, the SAM and the network link interface. As mentioned above, the SAM comprises a tamper-proof integration of necessary components, namely a processor, memory and interface much like the user's smart card. The communication between the card and the SAM thus passes through the logic controller. The logic controller is also active to collect the authentication result from the SAM and pass that result on to the access controller. The SAM can be a smart card or SIM card with a suitable interface/reader connected to the logic controller.

The data communication between a smart card and a SAM is typically encrypted. As is known in the art, it can involve an exchange of data that allows the smart card and the SAM to perform mutual authentication, for example using asymmetric encryption. This mutual authentication uses messages that do not allow an eavesdropper to be able to obtain information that could be used by the eavesdropper to gain authenticate in the future. The result of the authentication can be used, for example, to establish a temporary or ephemeral session key that then allows the smart card to transmit encrypted credential data to the SAM. The ephemeral key can originate at either end or can be negotiated between the two ends. In one example, the SAM can make the ephemeral key available to the controller by recording it in system memory of the controller. In this case, the SAM provides the ephemeral key to the controller, but the authentication is being done using the encrypted credentials sent from the badge to the controller without the SAM decrypting the credentials. The credential data can be, for example, an employee ID. For many installations, this is considered sufficient security, and is very simple for the user. The employee ID can be sent to the access controller where it can be determined whether the employee has permission to enter for the given door at the given time. The access controller communicates with the reader over a bus. Because the credential data is confidential data, this link can use secure communication with the establishment of encryption keys.

Authentication of the badge holder can use a variety of techniques. As an alternative example, the SAM can be used to decrypt information using asymmetric encryption that is then used to identify the badge holder.

In some cases, the smart card can also provide the SAM with biometric data or PIN data for the employee, so that when a PIN keypad, fingerprint reader or iris scanner is included at the reader, the logic controller of the reader (or the access controller, when the comparison is to be done at the access controller) can verify that the input given by the user matches what was stored in the smart card.

The logic controller can also control an audio or visual indicator for user feedback when a card cannot be read and/or when the access controller confirms or denies an authentication request. This can be important when the door control mechanism is a magnetic latch, whose release makes no significant audible sound when the door is opened.

The data link between the access controller and the door control mechanism can be encrypted or not as desired. The credential database can be local to the access controller or it can be remotely located over a secure data network.

Figure 2A:
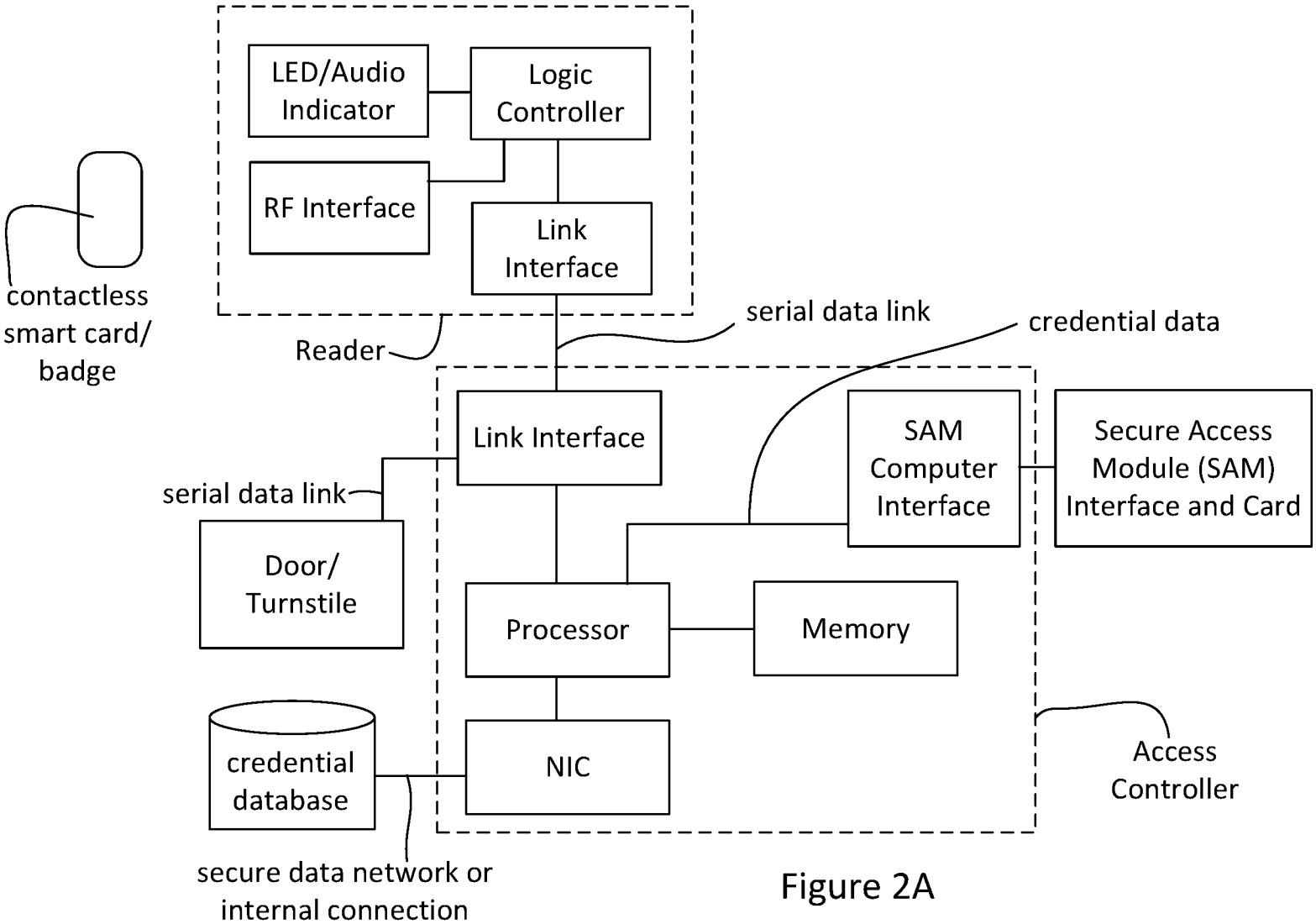
FIG. 2A is a schematic block diagram of an access control system according to one embodiment in which the SAM is moved from the reader to the access controller with the credential database being located outside of the controller.

In the embodiment of FIG. 2A, there is shown an access control system in which the reader is changed so as to have the logic controller of the reader send all of the communication with the smart card over the serial link to the access controller. The access controller (i.e. the central controller) comprises its own communication interface (the network interface controller (NIC) and the RS-485 link interface are but examples of suitable communications interfaces), processor, memory, an encryption interface (for example a SAM interface) and configuration for handling the communication and for controlling access as a function of credential data, for example, opening the door when the credential data matches the credentials of an authorized person in the credential database. The access controller is also modified to send all of the communication with the SAM that is local to the access controller. In this configuration, the reader and the access controller can be considered to be "transparent" in the communication between the card and the SAM. This transparent mode of operation can also be called operating in a pass-through mode enabling the exchange of data between an access card and the central controller in encrypted form. While the SAM can be considered to be external to the access controller, it can be housed securely within a housing of the access controller.

By providing a Secure Access Module (SAM) in the controller, the whole chain (badge to reader and reader to controller) can be secured by the same set of keys and the reader can be completely transparent. One particular architecture of such a solution uses n Secure Access Modules, centrally located with the controller, for serving authentication requests for m doors, where m may be larger (even much larger) than n. This takes advantage of the fact that while m doors may require m authentication requests, these are unlikely to be accessed simultaneously. The time for an authentication to complete using a conventional SAM can also be less than the time for a conventional door (particularly a door having a dampened automatic door closer) to be opened and closed by a person entering a secure area. Taking advantage of this fact, one or more SAMs or other encryption resources may be shared among doors using a sharing scheme, e.g. by providing a FIFO waiting queue for allocating incoming requests to secure access modules. Because the usage ratio of the SAMs may be low, a few SAM cards may suffice to support many doors. Using waiting queue theory, Applicant has determined that three SAMs may be used to accommodate up to nine independently distributed authentication requests per second with reasonable service times. It has been determined for a given conventional SAM that the probability of the wait time being less than 100 ms when 3 SAMs are used to handle 9 requests per second is about 85% with a maximum wait time of about 200 ms. Whereas, it has been determined that when 2 SAMs are used to handle 9 requests per second, there is only a 50% chance of a response time that is less than 300 ms and about a 70% chance of a response time less than 500 ms. This solution also minimizes the hardware requirements and simplifies deployment.

When a request comes in, the system can attempt to allocate one of the free SAMs. If a SAM is available, it can be reserved and allocated for the duration of the authentication request. If no SAMs were available, the request can be put in a waiting queue and the request is not immediately answered. When a request completes, the controller takes the next request from the waiting queue, if one was present, and assign the SAM to that request which may then proceed. The SAMs must be equivalent, so that users have a homogenous experience regardless of which of the SAM process their request.

Figure 2B:
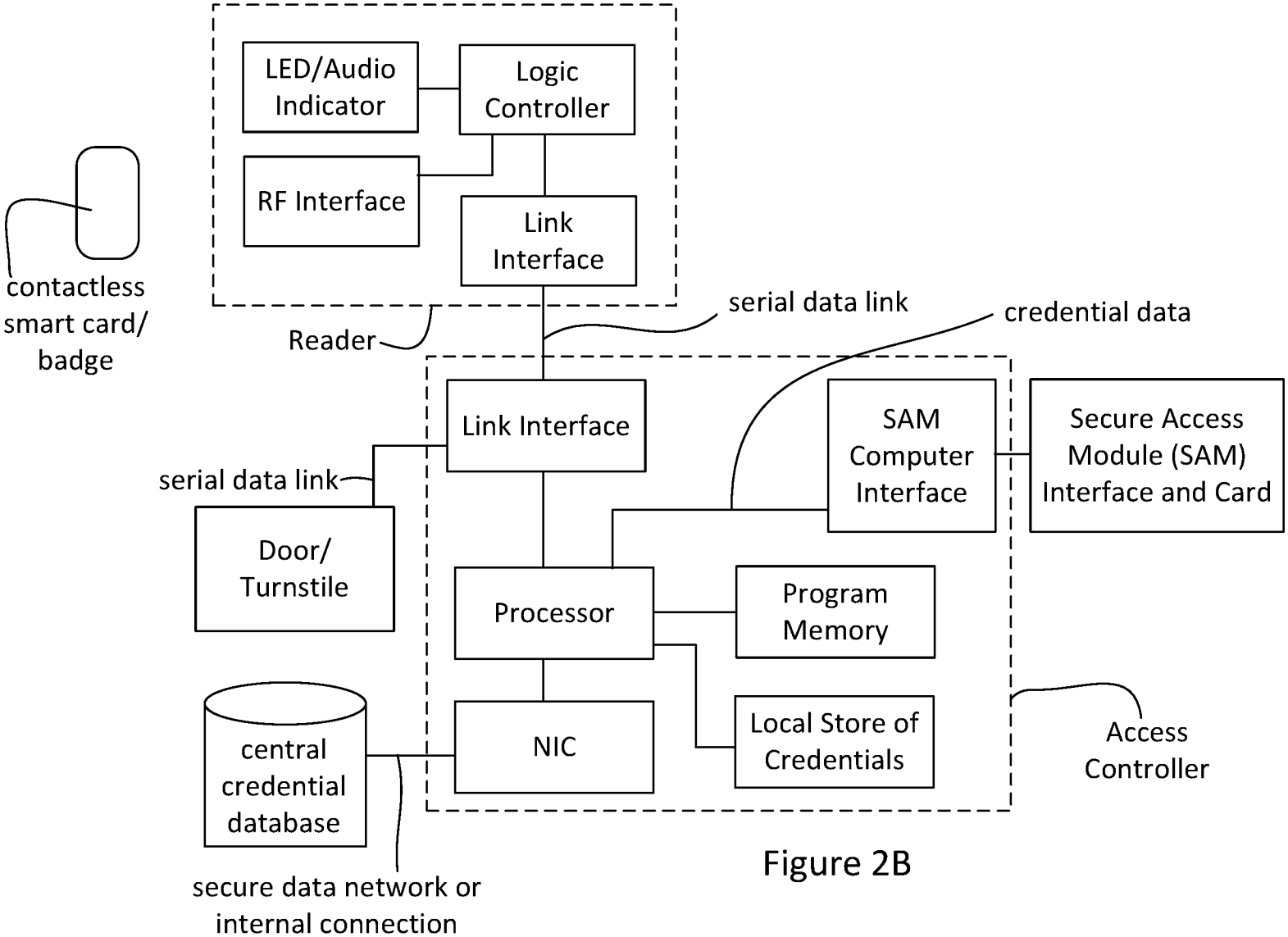
FIG. 2B is a schematic block diagram of an access control system according to another embodiment in which the SAM is moved from the reader to the access controller with the credential data being stored locally within the controller.

In the variant embodiment of FIG. 2B, the access controller includes a local store of credentials that can be synchronized with a central credential database over a secure network connection. The local store can be used for each authentication when a user badges at a reader at a door.

The access controller can be a computer having the interfaces for the readers. The connection to the door or turnstile control mechanism or door controller can be through a local bus or link, or it can be over a control network. Over this link, the access controller can send instructions to unlock a door, for example. Alternatively, the instructions can comprise waiving or disabling an alarm associated with opening a door or passage in an area that is not subject to an otherwise locked door or gate. The credential database can be a local database within the computer, or it can be a remote database accessed over a secure connection.

While the location of the SAM at the access controller does not change the exchange between the SAM and the smart card, it provides the advantage that the smart card credential data decrypted by the SAM are now at the access controller instead of the reader. This means that the credentials need not be encrypted by the reader for secure transmission to the access controller, and this means not having to manage encryption keys for this data link. The data link is of course used for communication of the exchange of cryptographic data between the SAM and the smart card, however, as previously mentioned, this is encrypted.

Figure 3:
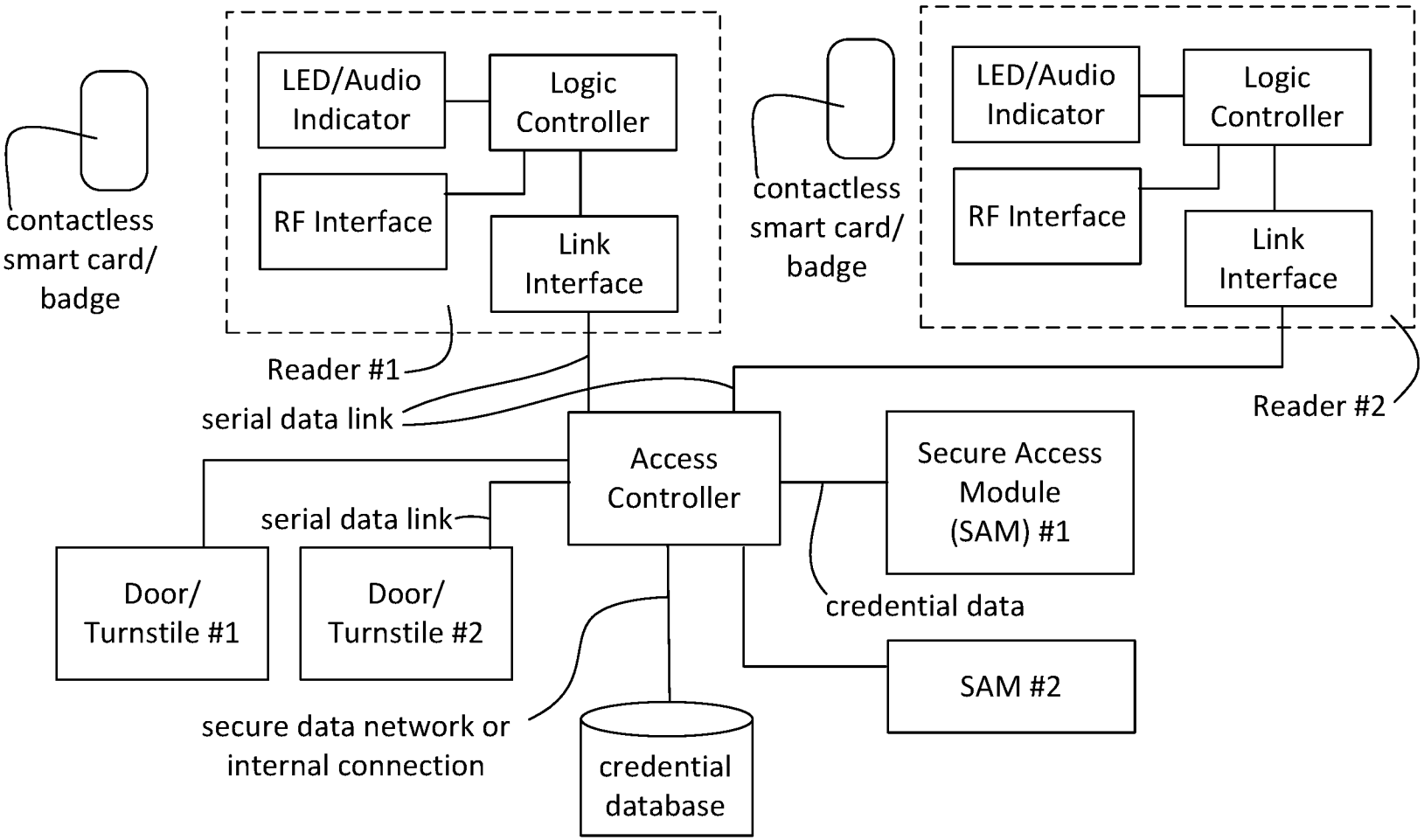
FIG. 3 is a schematic block diagram of an access control system according to another embodiment in which a number of SAMs are arranged at the access controller through individual bus connections for use by a larger number of readers.

In the embodiments of FIGS. 2A and 2B, it is of course possible to connect a number of readers to the access controller, as shown in FIG. 3. In this case, one can arrange at the access controller a SAM for each of the readers, and the access controller will take the data coming from and going to each serial data link and relay it to the respective SAM. This is illustrated in FIG. 3. It will be appreciated that the access controller can have a serial link port for each reader, or a network or shared bus arrangement can be provided. Relaying the data between respective smart card and SAM is handled by the access controller's processor.

The SAM interface as shown in FIGS. 2A and 2B can be implemented by a microcontroller that physically connects to the multiple SAMs and offers a USB interface to connect to the host processor. The SAM interface and the SAM connectors can be on a snap on mezzanine board and may or may not be present in a finished product. The SAM connectors can be commercially available smart card connector interfaces (wired or wireless, although a wired reader is preferred) or smart card sockets mounted to suitable boards and/or packaging (or connected by cable connectors). From the host processor point of view, the SAM interface, when present, will then in this implementation show up as a bi-directional serial port. The microcontroller can implement a custom protocol that allows addressing the SAMs individually. The microcontroller can also implement other low-level functions on the SAMs, namely card presence detection and card reset as well as functions related to the microcontroller itself (for example, a hello protocol for the discovery and microcontroller firmware update, and firmware version query).

The SAM interface can alternatively be implemented by using a USB smart card reader for each SAM card and by connecting a number of such USB card readers to the bus of the host computer, for example using a USB hub. The SAM interface in this variant embodiment can then make use of software control to recognize each USB device and to perform the handling of the flow of data between the externally connected card readers and the internally connected SAM card readers. In this situation, it will be appreciated that the embodiments of FIG. 2A or FIG. 2B can be provided using a conventional computer provided with appropriate interfaces, such as RS-485 or Ethernet (e.g. preferably over dedicated security physical cabling), to communicate with the card readers and door controllers, along with the mentioned exemplary USB devices, and the computer can then be provided with software to operate in accordance with the above-described embodiments. In some cases, a conventional access controller can be provided with the USB devices for interfacing with the SAM cards and with a software changes, the operation involving shared use of the SAM cards can be implemented.

When the application program in memory starts on the host processor, it can eventually try to detect the presence of the SAM interface microcontroller by querying the operating system for serial ports matching the expected USB device identifiers. It can then confirm the presence and functioning of the microcontroller by using its hello protocol. If the microcontroller is detected and functioning, its attached SAM cards can be detected. For each SAM card found, a card unlock procedure can be executed (this can be a cryptographic procedure to put the card in a ready state to process authentication requests). An entry with the card address can be added in a "card ready" FIFO stack for each card where the authentication procedure succeeded. The choice of a FIFO stack is for convenience and troubleshooting only. It could alternatively be a LIFO (stack) but a FIFO stack allows it to easily use all×SAM cards by badging× times and detect any faulty SAMs easily. A LIFO stack would require multiple simultaneous badging.

A task can constantly read from the virtual com port and reconstruct complete messages from the byte stream. Complete messages can be posted on a message queue to the SAM management task. Truncated or invalid messages are silently discarded.

While a queue can be used, it will be appreciated that it is possible that the access card presented to a reader could also be given no reply message when all of the SAMs are not available. In this way, the access card and/or reader can simply try again.

The SAM management task can track the state of the SAMs and accept requests (AcquireSam, ReleaseSam, SendSamCommand). The Acquire request may block the calling application until a SAM is available. In which case, the task is put in a waiting queue. The ReleaseSam request may unblock a task from the waiting queue if it was not empty. Otherwise, the released SAM can be added to the "card ready" FIFO stack. The SendSamCommand can send a command to the previously acquired SAM and block the caller until a response is received or a timeout is reached.

One can support at least two different modes of operations depending on the configuration. The first mode of operation uses only the hardware cryptographic engine present on the SAM. The second mode of operation uses the SAM to authenticate the badge then dumps the ephemeral cryptographic key to the host processor memory where the cryptographic operations pertaining to reading the credential is performed. This second mode of operation is faster, since the SAM is released immediately after the authentication but may be disallowed by the SAM configuration.

The sequence of events for the first mode of operation (SAM crypto only) can be as shown in FIG. 6. The SAM manager can be part of the host application in the memory accessible to the processor. The SAM manager is shown in FIG. 6 as being separate to make explicit the messaging between the components. The Acquire SAM command could be executed in parallel with the Card Authenticate command. For simplicity this is not currently implemented. The GenerateMac command can be needed to update the internal state of the SAM by computing a MAC on the next command so that it can decrypt the command response. This could also be done in parallel with the Read command to the reader. Waiting on the GenerateMac command is not needed.

When the second mode of operation is used, the GenerateMac command can be replaced by a DumpSessionKey command. Its response can contain the ephemeral session key. The SAM can be released immediately after. The host can then perform the deciphering by itself. This mode of operation reduces the SAM usage time by 1 round trip to the card and 1 round trip to the SAM, namely between about 60 ms to 100 ms depending on conditions.

As will be appreciated from FIG. 6, the controller processor can act as an intermediary between the card reader and the SAM. The controller host processor can initiate the interaction with the card reader and then pass through the authentication communication between the smart card and the SAM. The deciphered credential data is not returned to the card reader outside of the controller. The credential data can then be looked up in the controller's credential database as in FIG. 2B or using a secure network communication request as in FIG. 2A. If it is not found, the controller can refer to an authoritative source. If it is found, the controller can apply the access control policies, and signal to a door controller accordingly.

Figure 4:
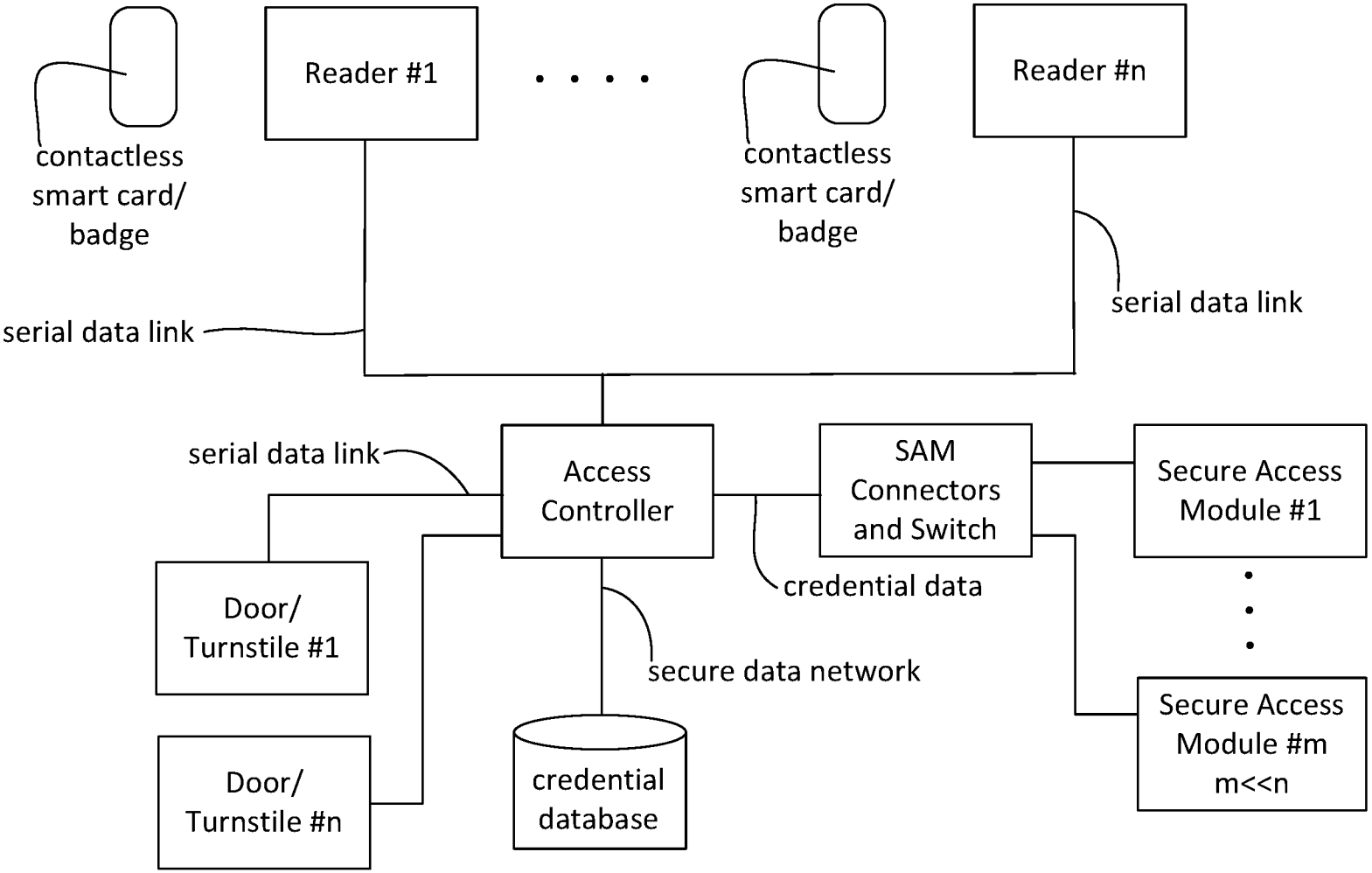
FIG. 4 is a schematic block diagram of an access control system according to another embodiment in which a number of SAMs are arranged at the access controller through a switch for use by a larger number of readers.

In the embodiment of FIG. 4, there are fewer SAMs than readers. The busy time of a SAM to authenticate a smart card is quite short, and the probability that most or all readers with receive a request to authenticate a badge at the same time is quite low. When a request for authentication is received at a reader, the authentication request is sent to the access controller. This request data can be relayed to an available one of the SAM's. If all SAMs were busy, there are two options. One is to not provide any response to the reader. The badging will be repeated and it is most likely that a SAM will be available next time. The other option is to queue the request until the next SAM becomes available. At this point, the first in line in the FIFO queue will have its request data relayed to the next available SAM.

The access controller must maintain a list of connections and manage the switching or relaying of the data. In FIG. 4, there is illustrated a SAM switch component. While this can be a physical switch, it is convenient to implement the list of connections and relaying within a processor in the access controller than to use a physical switch.

Figure 5:
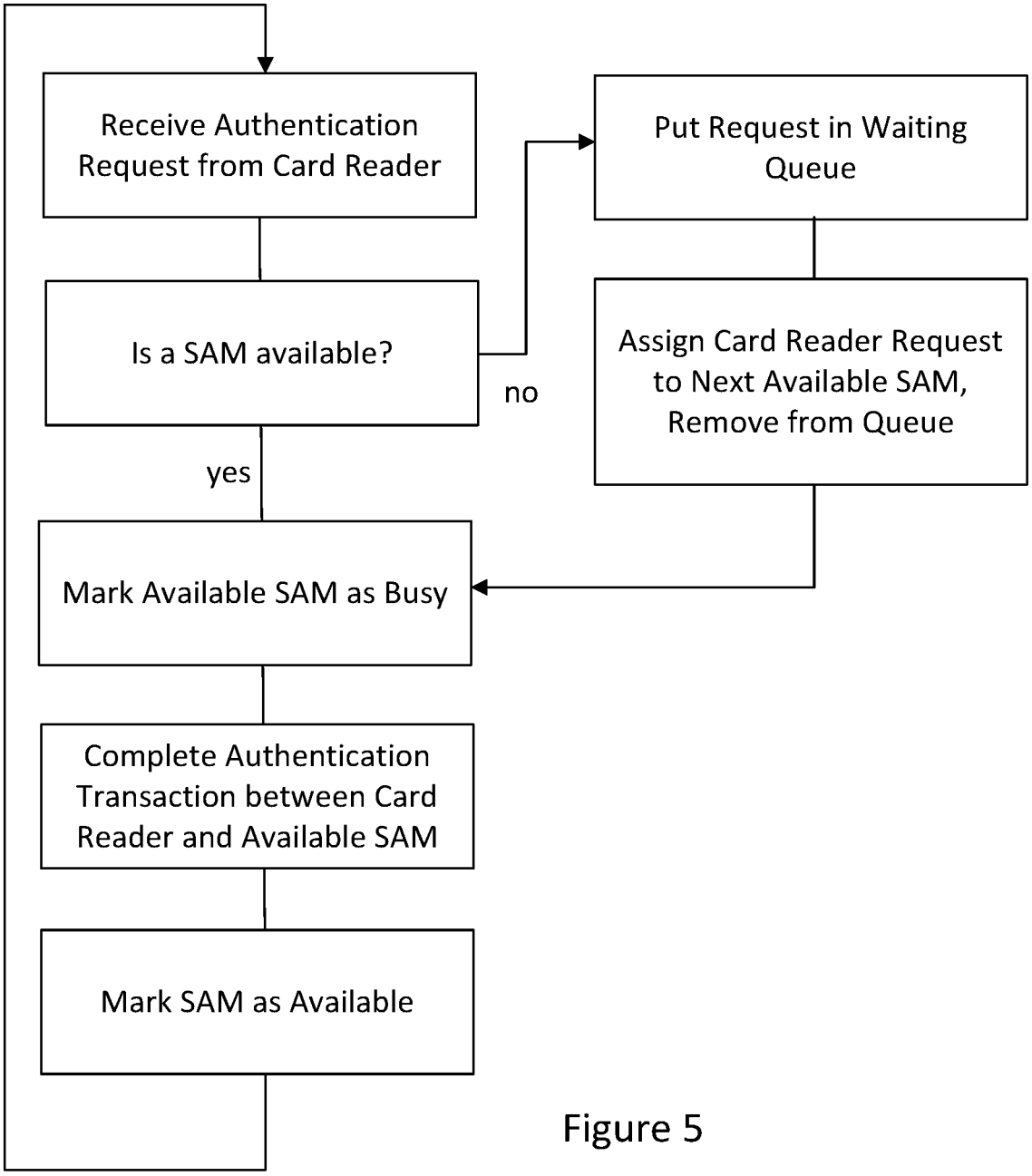
FIG. 5 is a flow diagram of operation of the access control system of FIG. 4.

The operation of the access control system of FIG. 4 will now be described with reference to FIG. 5. When a smart card is presented at a reader, as described above the RF interface of the reader interacts with the smart card to power the smart card. When the card is detected by the reader, the controller detects this over the interface link and a message is sent to the badge or card to begin the authentication request. This authentication request message is sent over the serial data link (or other data connection) to the access controller. The processor of the access controller then receives the request. The access controller then determines if one of its SAM's is available. The access controller can keep a list or table of SAM availability data in its memory for this purpose. If no SAM is available, namely all of the SAM's are handling authentication transactions, then the request can be placed in a queue. When the status of a SAM changes to available, then the request is assigned to the newly available SAM. If a SAM had been available, the available SAM is marked in the list as busy in the list or table. The list or table can also record which reader is assigned to the SAM so that the processor in the access controller can determine how the data is relayed.

The access controller then relays messages from the smart card and the SAM to complete the authentication transaction between the reader and the available SAM. When the transaction is done, the access controller takes the credential data and does not sent that back to the reader, but instead it uses it to determine if an access control signal should be issued to the door latch mechanism or the like. The access controller also marks in the list or table that the SAM is now available.

The number 'm' of SAM's used to serve 'n' readers can be chosen in a number of ways. A typical SAM may process two or three authentications per second. A typical time from the same reader being used for reading the badge of one user to the next is about 2 to 6 seconds depending on the door or turnstile operation. While this may suggest that one SAM can be used with about 4 to 18 readers, a delay in authentication will occur in the worst-case scenario that all SAMs are busy when a reader is presented with a badge. When the access controller is built to provide a large number of slots or connectors for SAMs, the operator of the access controller can decide on how many SAMs to purchase, and to balance the number of SAM's installed with any user complaints that the readers are slow or unresponsive. Alternatively, a model of expected reader activity and response times can be developed so that the number of SAM's can be selected for the desired maximum wait time that can be tolerated. In most cases, the number of SAM's can be less than about one half of the number of readers without causing any issues, and in some cases, the number of SAM's can be less than about one third of the number of readers without causing issues.

What is claimed is:

1. An access controller for use in a secure access control system having a number of smart card readers and door controllers, the access controller being operative to communicate with said smart card readers and door controllers for authenticating users and enabling authorized access to secured premises, the access controller comprising:

at least one communication interface connectable to said number of smart card readers and door controllers;

a plurality of secure access module (SAM) interfaces, each one of said SAM interfaces able to connect to a corresponding one of a plurality of SAMs and to communicate with any one of said number of smart card readers through said at least one communication interface.

2. The access controller as defined in claim 1, comprising a processor and program memory, said processor being connected to said at least one communication interface and to said plurality of SAM interfaces.

3. The access controller as defined in claim 2, wherein said SAM interfaces comprise a microcontroller connected to a plurality of SAM connectors and to a bus associated with said processor, said microcontroller being configured to handle messages from said processor and to direct communication between a desired one of said plurality of SAM connectors and said processor.

4. The access controller as defined in claim 3, wherein said access controller is operative to allow said number of smart card readers to use a smaller number of SAMs than said number of smart card readers for authentication, said processor and/or said microcontroller is further configured to manage queuing of smart card requests for authentication when said smaller number of SAMs are all busy.

5. The access controller as defined in claim 3, wherein said access controller is operative to use different authentication protocols, said SAMs each being associated with a given one of said different authentication protocols, and said processor and/or said microcontroller is further configured to manage directing smart card requests for authentication to said SAMs according to authentication protocol.

6. The access controller as defined in claim 2, wherein said SAM interfaces comprise a connection for each one of said SAM interfaces to a bus associated with said processor, said processor and memory being configured to direct communication between a desired one of said plurality of SAM interfaces and said processor.

7. The access controller as defined in claim 6, wherein said access controller is operative to allow said number of smart card readers to use a smaller number of SAMs for authentication, said processor and memory is further configured to manage queuing of smart card requests for authentication when said smaller number of SAMs are all busy.

8. The access controller as defined in claim 6, wherein said access controller is operative to use different authentication protocols, said SAMs each being associated with a given one of said different authentication protocols, and said processor and/or said microcontroller is further configured to manage directing smart card requests for authentication to said SAMs according to authentication protocol.

9. The access controller as defined in claim 1, further comprising a plurality of secure access modules (SAMs) connected to said SAM interfaces.

10. The access controller as defined in claim 9, wherein said processor and program memory are configured to verify credential data obtained from an exchange of data between user smart cards coupled to said smart card readers and secure access modules connected to said SAM interfaces and to signal said door controllers when said credential data is verified.

11. An access control system comprising:

an access controller for use in a secure access control system having a number of smart card readers and door controllers, the access controller being operative to communicate with said smart card readers and door controllers for authenticating users and enabling authorized access to secured premises, the access controller comprising:

at least one communication interface connectable to said number of smart card readers and door controllers;

a plurality of secure access module (SAM) interfaces, each one of said SAM interfaces able to connect to a corresponding one of a plurality of SAMs and to communicate with any one of said number of smart card readers through said at least one communication interface;

a number of smart card readers connected to said access controller; and a number of door controllers connected to said access controller.

12. The access control system as defined in claim 11, wherein a number of said plurality of SAM interfaces is fewer than said number of said card readers.

13. The access control system as defined in claim 12, wherein said plurality of SAM interfaces is fewer than about one half of said number of said card readers.

14. The access control system as defined in claim 12, wherein said plurality of SAM interfaces is fewer than about one third of said number of said card readers.

15. The access control system as defined in claim 11, wherein said access controller comprises a processor and program memory, said processor being connected to said at least one interface and to said plurality of SAM interfaces and managing the connection between said number of card readers and said plurality of SAM interfaces, said access controller comprises a queue stored in memory associated with said processor.

16. An access control method comprising:

providing an access controller with a plurality of secure access modules (SAMs);

detecting at one of a plurality of smart card readers associated with access control points a user smart card inserted into or presented to said one of said smart card readers;

selecting one of the SAMs in the access controller to communicate with said user smart card detected at said one of said smart card readers;

obtaining credential data from said communication;

controlling one of a plurality of door controllers associated with one of said access control points associated with said one of said smart card readers based on said credential data.

17. The method as defined in claim 16, wherein, when all of said SAMs are busy and further user smart cards are inserted into or presented to said smart card readers, communication with said further user smart cards is put into a queue until said SAMs become available.

18. The method as defined in claim 16, wherein, when all of said SAMs are busy and further user smart cards are inserted into or presented to said smart card readers, communication with said further user smart cards is not established until said SAMs become available.

19. The method as defined in claim 16, wherein said access controller obtains an ephemeral key from said SAMs to decrypt said credential data.

20. The method as defined in claim 16, wherein said access controller obtains credential information from said SAMs.

21. The method as defined in claim 16, wherein a number of said smart card readers is more than three times greater than a number of said plurality of SAMs.

22. A computer program product comprising computer-executable program code recorded on a computer-readable non-transitory storage medium, said computer-executable program code when executed in a computer forming part of an access controller connected to a plurality of SAMs, a plurality of smart card readers and a plurality of door controllers performing the method as defined in any one of claims 16 to 21.

* * * * *